United States Patent [19]

Kankaanpaa

[11] 4,332,191

[45] Jun. 1, 1982

[54] CALENDER

[75] Inventor: Matti Kankaanpaa, Espoo, Finland

[73] Assignee: Valmet Oy, Finland

[21] Appl. No.: 192,027

[22] Filed: Sep. 29, 1980

[30] Foreign Application Priority Data

Oct. 15, 1979 [FI] Finland ..... 793200

[51] Int. Cl.[3] ..... B30B 3/04

[52] U.S. Cl. ..... 100/162 R

[58] Field of Search ..... 100/160, 161, 162 R, 100/173; 34/117

[56] References Cited

U.S. PATENT DOCUMENTS

| | | | |
|---|---|---|---|
| 440,377 | 11/1890 | Snover | 100/162 R |
| 1,104,759 | 7/1914 | Sheahan | 34/117 |
| 3,270,664 | 9/1966 | Veneman | 100/162 R |
| 3,451,331 | 6/1969 | Fredrickson | 100/162 R |
| 3,905,288 | 9/1975 | Holm | 100/162 R |
| 4,128,053 | 12/1978 | Kankaanpaa | 100/162 R |

*Primary Examiner*—Billy J. Wilhite

*Attorney, Agent, or Firm*—Steinberg & Raskin

[57] ABSTRACT

Calender apparatus adapted to be directly associated with a paper machine for calendering a web leaving the same wherein at least two separate calendering units are mounted on a unitary frame spaced from one another. Each calendering unit includes at least one intermediate roll and two hard end rolls defining a respective pair of nips with the intermediate roll on substantially diametrically opposed sides thereof. The intermediate roll of a calendering unit may comprise a soft roll so that the pair of nips of the calendering unit are soft nips so that the calender apparatus comprises a supercalender.

14 Claims, 12 Drawing Figures

CALENDER

BACKGROUND OF THE INVENTION

This invention relates generally to paper machines and, more particularly, to calendering apparatus adapted to be directly associated with a paper making machine or the like to effect a calendering treatment of the paper web leaving the drying section of the machine and which comprises a plurality of hard rolls and at least one soft roll.

The paper web leaving the drying section of a paper machine is generally not suitable for sale as such in that additional finishing operations are still required. One of such finishing operations comprises calendering of the paper web by which the smoothness and gloss or finish of the paper is obtained as is its final desired density. Calendering is accomplished by conducting the continuous paper web through press nips defined between calender rolls as is well known.

Conventionally, calendering is effected through the use of a so-called machine calender which is directly associated with the paper machine. It is also well known that the calendering treatment may be supplemented when desired by supercalendering the web in a separate so-called supercalender.

Such calendering machines are constituted by rolls which may be hard rolls or soft rolls. In this connection, as used in the present context, hard rolls will be understood as referring to rolls having a hard, smooth surface formed of a material such as chill-cast iron, steel or the like. In the present context soft rolls will be understood as referring to rolls whose surface layer comprises a resilient, elastic, non-metallic material. In this connection, soft rolls generally comprise so-called filled rolls wherein the resilient material forming the same comprises paper sheets which have been assembled on the core or shaft of the roll at right angles thereto and which have been compressed under large forces to form a coherent, compact roll covering.

The rolls constituting a typical machine calender generally are all hard rolls. On the other hand, soft rolls are used in addition to hard rolls in the calender stack of supercalenders. Thus, in conventional, well-known supercalenders, hard and soft rolls alternate with each other in the calender stack so that the number of soft rolls is generally substantially the same as the number of hard rolls.

Further as used herein, the term "soft nip" shall be understood as referring in a calender to the line of contact between a soft roll and a hard roll located in nip defining relationship with each other. A "hard nip" will be understood as referring to the line of contact defined between two hard rolls which are in nip defining relationship in the calender stack.

The term "nip" or "nip zone" will be understood as being used in its broad sense, i.e., referring not only to the line of contact between two rolls but, additionally, as referring to that region of a roll or rolls where a nip can be established. The operation of separating two rolls which are in mutual nip defining relationship will be referred to as opening a nip while the term closing a nip will be understood as referring to the step of moving two rolls which are initially separated from each other into nip defining contact with each other.

Furthermore, as used in the present context the terms "machine calendering" and "machine burnishing" refer to the treatment of a web which is effected exclusively as the same passes through a hard calender nip as a result of which the web is compacted and its surface smoothed so as to obtain a so-called "machine finish". Likewise, the terms "supercalendering" or "super burnishing" will be understood as meaning the web treatment which is effected in soft calender nips and as a result of which a gloss is imparted to the web surface which is substantially superior to the machine finish obtained in hard calender nips. In this connection, it is understood that hard nips may also be found in supercalenders. However, in the context of the present invention, the term "super gloss", rather than indicating the degree of glossiness imparted to the paper web, instead refers to the fact that the gloss of the web surface has been produced at least in part by a supercalendering process in soft nips. The degree of super gloss accordingly may vary depending, for example, on the number of soft nips utilized in the supercalendering process, on the nip pressure, etc.

Depending on the type of paper which is being treated and on the requirements for the finished product, machine calendering may be accomplished utilizing only a single nip calender, i.e., a calender defined by a single pair of rolls. However, conventionally, a machine calender stack will comprise from six to eight rolls which correspondingly define between five and seven nips.

Generally, the object of the supercalendering process is to obtain an equal gloss on both surfaces of the paper. For this reason, the paper web is generally arranged to pass through the soft nips in a manner such that both surfaces of the web will alternately face a hard roll whose hard, smooth surface will act to produce a gloss to a greater extent than the surface of a soft roll.

In any event, two soft nips will not provide a super gloss to the paper web which would be substantially superior to a machine finish. For this reason, the number of soft nip pairs in supercalendering is usually greater than one and in practice separate supercalender stacks may be utilized having up to ten nip pairs.

In an effort to increase production in paper machines, attempts have been made to design calenders which combine the functions of both machine calenders and supercalenders. For example, applicant's U.S. Pat. No. 4,128,053 discloses a unitary machine-supercalender which is adapted to be directly associated with a paper machine and which is constituted by a conventional roll stack defined by a series of hard rolls and wherein a substantially equal number of soft rolls situated outside of the roll stack in nip defining relationship with the hard rolls define soft nips therewith.

With the above-mentioned combined machine calender and supercalender, it is possible to effect a supercalendering of the web in a desired manner immediately upon the web leaving the paper machine without the need for any intermediate operations. However, it has been found that in certain situations the super-gloss imparted to the paper web by the calendering treatment effected by such apparatus is not entirely satisfactory in that the gloss is spotty or mottled rather than being uniform, i.e., localized areas of the surface of the paper web have a higher gloss than other areas. Furthermore, it has been found that a web being subjected to treatment in such machine-supercalender has a tendency to blacken at localized regions due in part to the drawback that the hard nips found in such apparatus are unduly hard and inelastic with respect to the paper being produced.

Additionally, in cases where the machine-supercalender disclosed in the above-identified U.S. Pat. No. 4,128,053 is constructed for treatment of paper webs having relatively large widths, e.g., 7–8 meters, it is necessary to construct the soft rolls so as to have relatively large diameters in view of the nature of their construction which would otherwise cause the soft rolls to have inadequate rigidity over their length. These requirements inherently give rise to various structural and functional drawbacks which affect the construction of the entire apparatus.

SUMMARY OF THE INVENTION

Accordingly, one object of the present invention is to provide new and improved calender apparatus for direct connection to a paper machine and which does not have the structural and functional drawbacks discussed above.

Another object of the present invention is to provide calender apparatus through which the web can be threaded during the start-up phase of the paper machine and calendering apparatus at the full operating speed of the paper machine, i.e., while the paper machine is continuously running at normal speeds.

Briefly, in accordance with the present invention, these and other objects are attained by providing calender apparatus comprising at least two separate calendering units mounted on a unitary frame and spaced from one another. Each of the calendering units includes at least one intermediate roll and two hard end or confining rolls which define press nips with the intermediate roll at substantially diametrically opposed sides thereof.

Further in accordance with the invention, in order to make possible and facilitate the threading of the web through the apparatus during the start-up phase, e.g., when the paper machine operation has begun, apparatus are provided for opening and maintaining open the nips in at least one section of the apparatus during such start-up phase.

In the illustrated preferred embodiment, the calender apparatus is further provided with a flexible carrier, e.g., rope carrier, system which is known per se in the art, for threading the web at least partly through the apparatus.

In a particularly advantageous embodiment of the invention, the calender apparatus comprises two calendering units, the intermediate roll of each such unit comprising a soft roll so that both of the calendering units comprise supercalendering units which are exclusively adapted for supercalendering treatment of the paper webs. The axes of the rolls in each calendering unit are substantially situated in a common plane so that the hard end rolls are situated on diametrically opposed sides of the intermediate soft roll whereby the loads imparted on the intermediate roll at the press nips defined by the end rolls in effect cancel each other. As a consequence of this structure, the soft intermediate roll can have a relatively small diameter which of course comprises a significant advantage relative to the prior art structure discussed above. The hard end rolls preferably comprise deflection-adjustable or deflection-minimized rolls in order to achieve maximum uniformity of lineal pressure loading across the web in the nips defined thereby.

In one calendering unit the same surface of the web will face and be contacted by the hard end rolls in both nips of a calendering unit. Where it is desired to effect a symmetrical or equal treatment of both surfaces of the web, the latter is conducted into a second calendering unit in a manner such that the opposite surface of the web will face the hard rolls therein.

It is well known that the surfaces of a web manufactured according to conventional techniques may exhibit different characteristics, i.e., may present asymmetry or a so-called two-sidedness, with respect to its surface structure and properties, to an extent such that one surface thereof will require a higher degree of calender treatment than the other surface in order to achieve an equal gloss on both surfaces. In such situations, an odd number of calendering units is preferably employed. In fact, the desired results can in some instances be achieved utilizing only a single calendering unit.

In the operation of calender apparatus according to the present invention, the following functional variants must be separately considered:

(a) the start-up phase; and (b) the continuous operation phase.

Considering the start-up phase of the machine, the web will often arrive at the calender apparatus in an intermittent, uneven and/or folded fashion or possibly even having large lumps formed therein. The soft nips of the calender apparatus must accordingly be open in order to prevent the soft rolls from becoming damaged. The threading of the web through at least the units which comprise supercalendering units may be effected by means of a rope carrier system as mentioned above. The start-up phase terminates when a stable, continuous and undisturbed running of the web through the calender nips is achieved.

With respect to the continuous operation phase of the calender apparatus, the apparatus of the invention will function as a supercalender by means of two structural and functional variants, namely (1) wherein supercalendering is effected in only the soft nips of the apparatus, and (2) wherein in order to enhance and improve the supercalendering, the web is treated in one or more hard nips prior to being conducted into the soft nips defined by the soft, e.g., filled paper, rolls.

Where one or more hard nips preceed soft nips, the web can be softened to an extent and larger irregularities or areas of discontinuities can be eliminated before the supercalendering treatment is commenced. As a consequence of these two preliminary operations, the supercalendering of the web can be effected in an easier fashion and rendered more effective than where the treatment is effected on a "raw" paper web.

DESCRIPTION OF THE DRAWINGS

A more complete appreciation of the present invention and many of the attendant advantages thereof will be obtained by reference to the following detailed description when considered in connection with the accompanying drawings in which.

DESCRIPTION OF THE PREFERRED EMBODIMENTS

Figure 1A:
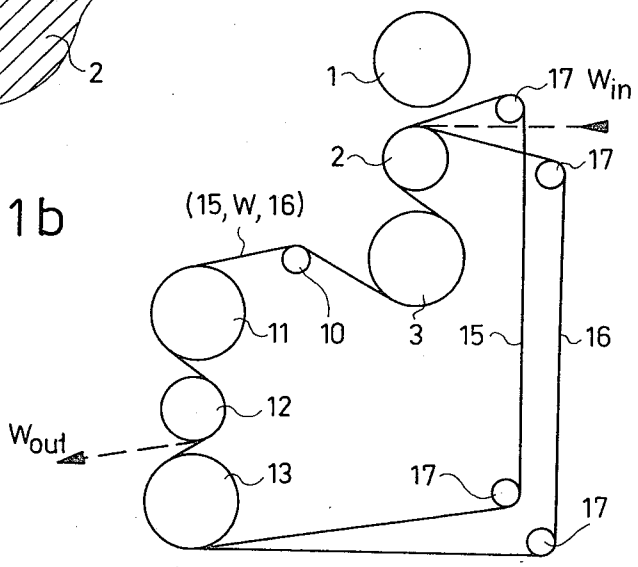
FIG. 1*a* is a schematic illustration of the apparatus illustrated in FIG. 1 showing the position of the rolls during the start-up phase of the machine with the web being threaded therethrough and also illustrating a rope carrier system in conjunction therewith.
Figure 1B:
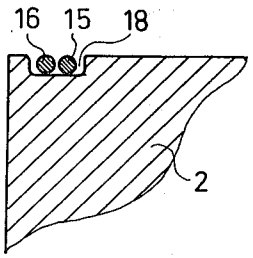
FIG. 1*b* is a partial section view of one roll of the calender apparatus illustrated in FIG. 1*a* and illustrating the associated rope carrier system.
Figure 1:
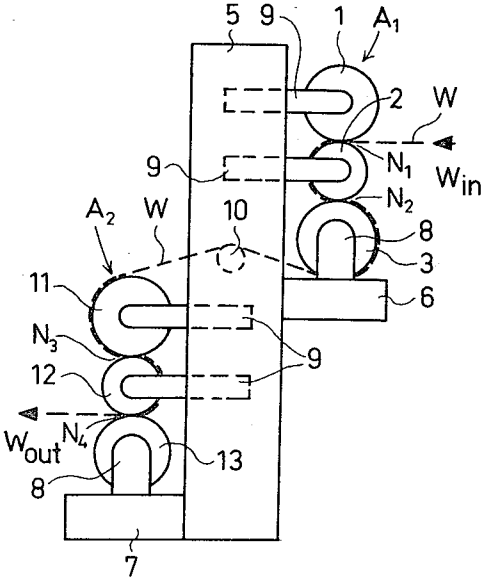
FIG. 1 is a side elevational view of calender apparatus according to the present invention and illustrating the frame structure and supporting and displacement apparatus for the various rolls thereof.

Referring now to the drawings wherein like reference characters designate identical or corresponding parts throughout the several views, and more particularly to FIG. 1, the calender apparatus comprises six rolls which are arranged in two separate groups, each of which includes three rolls. These groups will be referred to hereinbelow as supercalendering or calender units.

The first supercalendering unit, designated A1, comprises a stack formed of three rolls, 1, 2 and 3, the intermediate roll 2 comprising a soft or so-called filled roll while the end rolls, 1, 3 comprise conventional hard or metal rolls formed, for example, of chilled cast iron. Rolls, 1, 2 and 3 are situated over each other in a manner such that their respective axes are situated substantially in a common vertical plane. In this manner a pair of soft nips, $N_1$, $N_2$ are defined on substantially diametrically opposed sides of the soft roll 2. A frame comprising two upstanding columns 5 (only one shown) have support members 6 cantilevered therefrom on which bearing housings 8 for the roll 3 are supported. The rolls 1 and 2 are rotatably mounted on respective loading and lifting arms 9 which, together with their associated mechanisms, are conventional and well known to persons having skill in the art.

The second supercalendering unit $A_2$ is similar to the first supercalender unit $A_1$ and comprises a pair of hard or metal end rolls 11, 13 and an intermediate soft roll 12, the soft nips being defined by rolls 11, 12 and 13 being designated $N_3$ and $N_4$. The lower end roll 13 is rotatably journalled in bearing housings of cantilever members 7 while rolls 11 and 12 are journalled in loading and lifting arms 9 like those on which rolls 1 and 2 are mounted. The calendering units $A_1$, $A_2$ are mounted on opposed sides of the vertical frame 5. Furthermore, in the same manner as in calender unit $A_1$, the axes of the rolls 11, 12 and 13 are substantially situated in a common vertical plane.

A paper guide and spreading roll 10 is rotatably mounted in the calender frame at its substantial mid-height.

Conventional apparatus is utilized for driving the rolls in each of the calender units. For example, each of the rolls in each of the calender units can be provided with its own drive means. Thus, the rolls 3, 13 are provided with their own respective drive apparatus, e.g., a variable speed electric drive, with the rolls 1, 2, 11 and 12 also preferably having their own respective drive motors. Such individual drives may be required particularly during the start-up phase of the machine operation. On the other hand, however, the rolls 1, 2, 11 and 12 may be driven from the rolls 3 and 13 by conventional means such, for example, as through belt drives.

The calender apparatus is illustrated in FIG. 1 in its normal and continuous operation phase, i.e., wherein the nips defined between the various rolls are closed in both of the supercalendering units $A_1$, $A_2$. In the illustrated embodiment, the drive of the first calender unit is provided by a variable speed drive motor coupled to the lower end roll 3 with the roll 2 deriving its rotation from the lower roll 3 and, similarly, with the roll 1 rotating through nip contact with roll 2.

The web W which is leaving the drying section (not shown) of the paper machine is guided into the soft nip $N_1$ of the first supercalendering unit $A_1$ as indicated by $W_{in}$. The web is carried on the surface of the roll 2 into the second soft nip $N_2$. As seen in FIG. 1, the undersurface of the web W faces the soft roll 2 in both of the nips $N_1$, $N_2$. Generally, the web is burnished in a supercalender nip to a greater extent on the surface which faces the hard roll. After the nip $N_2$, the web laps the roll 3 and is guided over the paper guiding and spreading roll 10 to the second supercalender unit $A_2$.

The rolls of the second supercalendering unit $A_2$ are preferably driven in the same manner as the rolls of the first supercalendering unit, i.e., by means of a drive motor connected to the lower end roll 13 with the rolls 11 and 12 being rotated through direct or indirect friction contact with roll 13. The rotational speed of roll 13 is adjustable so that a suitable tension can be maintained in the web as it travels between the first and second calender units.

In the second supercalendering unit $A_2$, the web arrives on the surface of upper end roll 11, enters the nip $N_3$ and continues on the surface of roll 12 to the nip $N_4$. After passing through the latter nip, the web is conducted to a reeling device (not shown) as indicated by $W_{out}$.

As seen in FIG. 1, the side of the web which faced the hard rolls as the web passed through nips $N_1$, $N_2$ in calender unit $A_1$ faces the soft intermediate roll 12 as the web passes through nips $N_3$, $N_4$ of the second calender unit $A_2$. In this manner, an equal or symmetrical treatment is effected on both surfaces of the web W.

As noted above, however, it is possible that the web entering the calender apparatus may have a two-sidedness such that one surface thereof will obtain a gloss easier than the other surface. For example, a web produced in a single-wire Fourdrinier machine will inherently have a smoother upper surface relative to the lower surface which faced the wire. When such a web is treated by calender apparatus according to the present invention as illustrated in FIG. 1 and it is desired to provide an equal gloss on both surfaces of the web, a higher nip pressure can be provided at the nips $N_3$, $N_4$ in the second calender unit $A_2$ (which imparts the gloss to the undersurface of the web) than the nip pressure present in the nips of the first calender unit $A_1$. Of course, such nip pressure can be adjusted by means of the arms 9 as described above. Such a progressive increase in the nip loading from the first to the second calender unit has other beneficial effects in the calendering process as will be understood by those skilled in the art.

Of course, the above-described operation of the apparatus is in the continuous operation phase thereof. The start-up phase of the calender apparatus will differ from the operation described above in that all of the nips will be open in order to avoid damage to the soft rolls for the reasons already mentioned. The threading of the web through the calender apparatus cannot be effected in the same way as is normally done in conventional machine calenders including the machine supercalender disclosed in U.S. Pat. No. 4,128,053 which utilize hard nips. For this reason, the calender apparatus of the present invention is provided with a flexible carrier or rope carrier system which is known per se by those skilled in the art and which has in the past been utilized in the press or drying sections of paper machines. The rope carrier system of the calender apparatus is schematically illustrated in FIGS. 1*a* and 1*b* and in principle is similar to that disclosed in U.S. Pat. No. 1,104,759 which illustrates the use of such rope carrier systems in the drying section of a paper machine. The rope carrier system comprises two endless ropes 15, 16 whose runs are adjacent to one of the upstanding frame columns 5. The ropes 15, 16 are guided by sheaves 17 and in grooves 18 (FIG. 1*b*) formed in the shells of the calender rolls. Thus, the ropes 15, 16 are illustrated as being situated within the groove 18 formed in roll 2 in FIG. 1*b*.

Referring to FIG. 1*a*, the calender apparatus is illustrated at the start-up phase with the nips $N_1$, $N_2$, $N_3$ and $N_4$ being maintained open by means of the loading and lifting arms 9 as described above. A relatively narrow strip of the web $W_{in}$ arriving from the machine drying section is introduced into the throat defined between the ropes 15 and 16 at the point where these ropes are being conducted into the rope groove 18 of roll 2. To thread the web into the calender apparatus, the rolls are driven whereupon the narrow strip lead or "tail" is carried along between the ropes 15 and 16 as the latter travels around the calender rolls in the same path corresponding to the path of web travel during the continuous operation phase. Subsequent to the web being threaded in this manner, the nips are closed whereupon the continuous operation phase is initiated. Thus, during threading of the web, the rolls 1, 2, 11 and 12 must each be positively driven so that each roll may be provided with its own drive system, preferably comprising an adjustable speed motor, or, alternatively, these rolls may be rotated through suitable drive transmissions from the rolls 3 or 13, respectively, e.g., through a belt drive, with the rolls 3 and 13 being provided with main drive motors.

Figure 2:
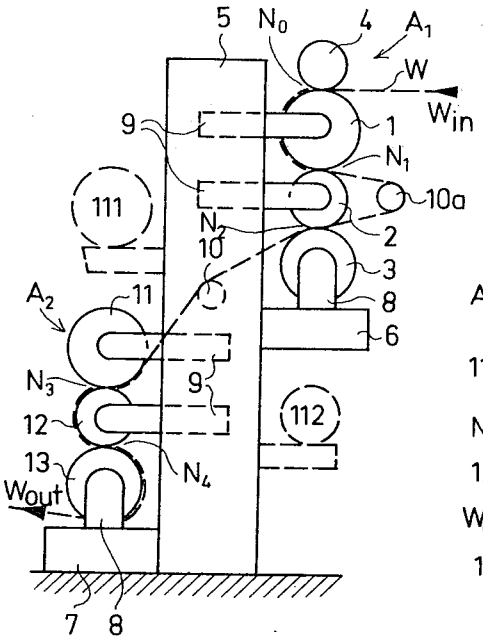
FIG. 2 is a side elevation view of another embodiment of the calender apparatus of the present invention.

Referring now to FIG. 2, calender apparatus according to the present invention is illustrated which differs from the embodiment illustrated in FIG. 1 in that the first supercalendering unit $A_1$ further comprises a fourth roll 4 which is a hard roll and which defines a hard nip $N_0$ with the roll 1. Roll 4 is preferably situated so that its axis is in the same plane which contains the axes of rolls, 1, 2 and 3, although other locations for roll 4 are possible. The purpose of roll 4 is to equalize or smooth out major non-uniformities which may be present in the web entering the calender apparatus and, additionally, to soften the web prior to the supercalendering process which is thereby enhanced.

Further, an additional paper guide roll 10*a* is situated outside of the roll stack of calender unit $A_1$ so that the web to be calendered can be passed over the same as it travels from nip $N_1$ to nip $N_2$. The roll 10*a* operates as a web spreading roll in a known manner as in conventional supercalenders.

In continuous operation phase, the calender apparatus illustrated in FIG. 2 operates in a manner such that web W enters the apparatus at $W_{in}$ into the hard nip $N_0$ and passes on the surface of hard roll 1 to the first soft nip $N_1$. The web W is then conducted over the guiding and spreading roll 10*a* to the second soft nip $N_2$ from which it is then directed by a second spreading roll 10 to the second supercalendering unit $A_2$. In the first supercalendering unit $A_1$, the undersurface of the web W faces the hard roll in the nips $N_1$ and $N_2$ so that this undersurface acquires in this calender unit a higher gloss than the top surface of the web.

The web W is conducted into the nip $N_3$ of the second supercalendering unit $A_2$ so that the top surface of the web which previously faces the soft roll 2 in nip $N_2$ will now face the hard roll 11 in nip $N_3$. As mentioned hereinabove in connection with FIG. 1, the top surface of the web is often inherently smoother than the underside thereof and in such cases, it may be desirable to provide a lower line or nip pressure in the nips of the second supercalendering unit than in the first. After leaving nip $N_3$, the web follows the surface of the soft intermediate roll 12 whereupon it enters nip $N_4$ from which the web may be conducted after lapping the lower roll 13 to appropriate reeling apparatus (not shown).

The provision of guiding and spreading rolls 10 and 10*a* illustrated in FIGS. 1 and 2 is necessary in order to obtain a trouble free path for the web since the latter tends to become distended in the soft nips. In some instances depending for example on the type of paper being calendered or on the nip pressure being used, it may be necessary to provide a separate spreading roll for each web run between two consecutive nips.

As seen in FIG. 2, the frame structure of the calender apparatus of the present invention provides a convenient storage area for spare calender rolls so that in the event that any roll is damaged during operation, a spare roll is immediately available for rapid replacement thereof. Thus, spare hard and soft calender replacement rolls 111 and 112, respectively, are supported on platform members associated with the frame 5 and apparatus for movement and hoisting of the spare rolls (not shown) are provided.

In the embodiments of the invention illustrated in FIGS. 1 and 2, it is essential that the supercalendering units include a soft intermediate roll situated between two hard end rolls. A greater number of calendering units, i.e., more than two, can be provided depending upon the extent to which the paper or paperboard web requires calendering treatment or on other factors. Furthermore, it is not essential that the roll stacks of the various calender units comprise a group of vertically situated rolls. For example, it is possible in certain instances to form each calender unit of a group of horizontally situated rolls.

Figure 3:
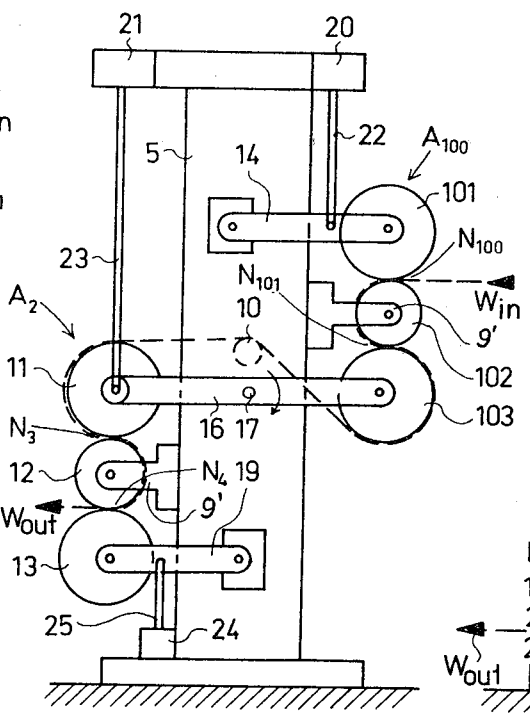
FIG. 3 is a side elevation view of still another embodiment of the calender apparatus of the present invention wherein the intermediate rolls are fixedly journalled.

Referring now to FIG. 3, calendering apparatus according to the present invention is illustrated which differs from the embodiments illustrated in FIGS. 1 and 2 in that the intermediate rolls 102 and 12 of the calender units $A_{100}$ and $A_2$, respectively, are journalled in fixed supports 9' carried by the frame 5 whereas the remainder of the rolls are journalled in arms which are pivotally connected to the frame 5 and which are themselves associated with means for applying a force to the arms for reasons which will become clear hereinbelow. The positions of the supports 15 and 18 are adjustable.

More particularly, in the illustrated embodiment the calender roll 101 is suspended at one side of the upstanding calender frame 5 from one end of arms 14 which are carried by rods 22 which themselves are connected to force applying means 20, such for example as diaphragm motors. The roll 103 is journalled at one end of elongate arms 16 which are pivotally mounted at their substantial mid-points by pivot pins 17 to the calender frame 5. Roll 11 is journalled at the other end of arms 16 and rods 23 are connected at their lower ends to arms 16 and at their upper ends to force means 21 such, for example, as diaphragm motors, in a manner such that the single set of force means 21 are utilized to open nip $N_{101}$ in the supercalendering unit $A_{100}$ as well as the nip $N_3$ in the supercalendering unit $A_2$.

The supercalendering unit $A_2$ is mounted on the opposite side of frame 5 from unit $A_{100}$. The supercalendering unit $A_2$ includes hard rolls 11 and 13 and an intermediate soft roll 12 substantially the same as the supercalendering units $A_2$ illustrated in FIGS. 1 and 2. Thus, rolls 11, 12 and 13 define the soft supercalendering nips $N_3$ and $N_4$. The hard lowermost end roll 13 is journalled at the ends of arms 19 which are pivotally connected to frame 5, the arms 19 being pivotable through connection to respective rods 25 which themselves are associated with force means 24 such, for example, as diaphragm motors, situated at the bottom part of frame 5.

Alternatively, the intermediate roll 102 of the calender unit $A_{100}$ illustrated in FIG. 3 may comprise a hard roll so that in this manner the nips $N_{100}$ and $N_{101}$ comprise hard nips. In this manner, the calendering apparatus will comprise a combination of a machine calender and a supercalender wherein the web W will first be conducted into two hard calendering nips $N_{100}$ and $N_{101}$ which effect a web pre-treatment whereupon the web W is then conducted over the spreading and guide roll 10 to the supercalending unit $A_2$ of the invention.

The provision in the embodiment of FIG. 3 whereby the hard rolls 11 and 103 are journalled at respective ends of the double ended arms 16 which can be pivotted by a single set of force means 21 in order to open and close the nips $N_{101}$ and $N_3$ as well as to impose desired loading thereon is also quite advantageous. The machine calendering unit $A_{100}$ may if desired comprise more than three hard rolls and two hard nips. For example, a calendering unit such as unit $A_1$ illustrated in FIG. 2 may be utilized.

Still referring to FIG. 3, after passing through the calender unit $A_{100}$, the web travels through the supercalendering unit $A_2$ in a manner such that its undersurface faces the hard rolls 11 and 13 and will therefore acquire a higher gloss than the top surface of the web. In those cases where the web is significantly asymmetric or two-sided, e.g., where the top surface is significantly smoother or more readily burnishable than the undersurface due to the effect of the wire section of the paper machine, the embodiment of the invention illustrated in FIG. 3 wherein the intermediate roll in calender unit $A_{100}$ comprises a hard roll so that unit $A_{100}$ comprises a machine calendering unit, will result in a relatively equal gloss being acquired by both surfaces of the web even though only a single supercalendering unit, i.e., unit $A_2$, is employed.

Figure 4:
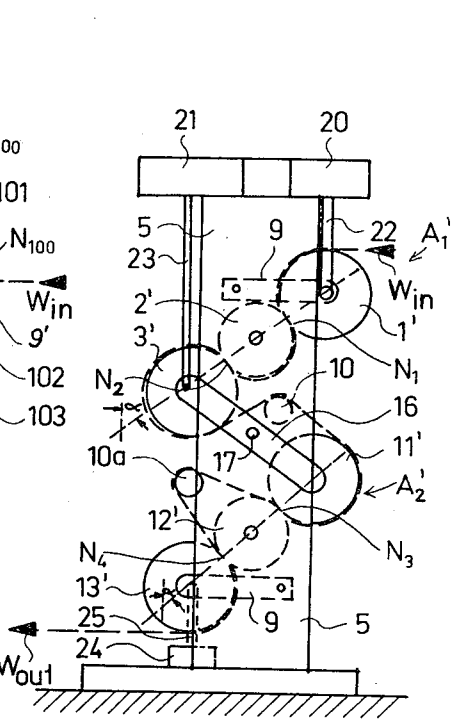
FIG. 4 is a side elevation view of yet another embodiment of the calender apparatus of the present invention which comprises a pair of supercalendering units, the axes of the rollers of each such unit being substantially situated in a plane which is inclined with respect to the vertical.

Referring now to FIG. 4, calender apparatus is illustrated comprising two supercalendering units $A'_1$ and $A'_2$. Supercalendering unit $A'_1$, comprises hard end rolls 1', 3' and a soft intermediate roll 2' while supercalendering unit $A'_2$, comprises hard end rolls 11' 13' and a soft intermediate roll 12'. The axes of the rollers of the respective supercalendering units are substantially situated in respective planes which are inclined at an angle $\alpha$ to the vertical. The soft intermediate rolls 2', 12' are rotatably fixed between the upstanding columns of frame 5 while the lowermost hard roll 3' of the first unit $A'_1$, and the topmost hard roll 11' of the second unit $A'_2$, are mounted at respective ends of a double ended arm 16 similar to that illustrated in FIG. 3 so that the soft nips $N_2$, $N_3$ are openable, closable and loadable by means of a single force means 21 which acts through rods 23. The uppermost hard roll 1' of the first calender unit $A'_1$, is journalled to the ends of loading and lifting arms 9 which themselves may be turned by force means 20 through rods 22. Similarly, the lowermost hard roll 13' of calender unit $A_2$, is journalled at the ends of loading and lifting arms 9 which may be pivotted by force means 24 through rods 25. In this manner, calender apparatus having a relatively simple mechanical construction is obtained and which, additionally, has a relatively small structural height.

Referring now to FIGS. 5A–5F, various embodiments of the present invention are schematically illustrated with the mounting apparatus, loading and lifting means and web guiding and spreading rolls being omitted for the sake of clarity, it being understood that such omitted elements are in principle essentially the same as those discussed above in connection with the embodiments of FIGS. 1–4. For the sake of clarity and simplicity, and to enable an easy comparison of the respective embodiments, hard rolls have been represented with hatching while soft rolls are indicated without hatching. The web has been represented by a dashed line while the direction of travel of the web is indicated by appropriate arrow heads.

Figures 5A, 5B, 5C, 5D, 5E, 5F:
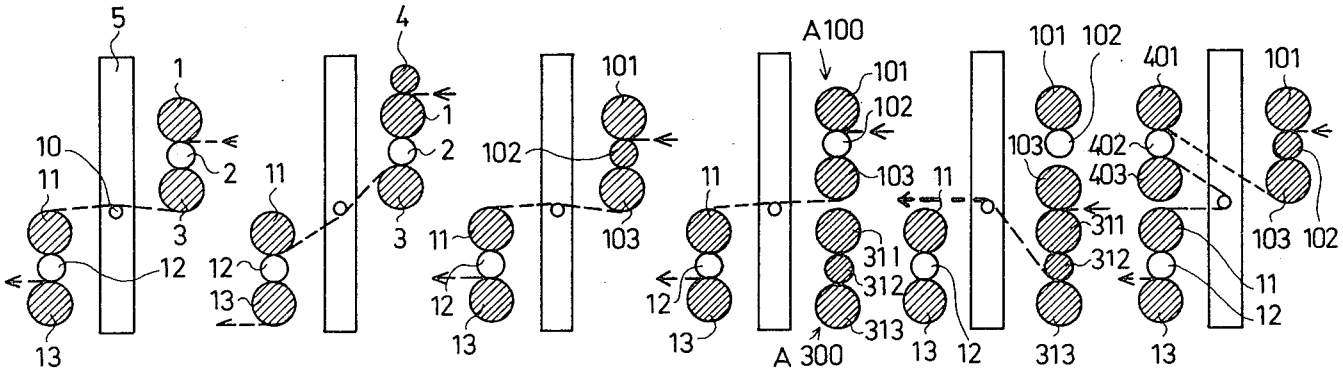
FIGS. 5A through 5F are schematic views of various embodiments of the calender apparatus of the present invention.

The embodiment of the calender apparatus illustrated in FIG. 5A is equivalent to that illustrated in FIG. 1, discussed above.

Similarly, the embodiment of the calender apparatus illustrated in FIG. 5B is equivalent to the embodiment illustrated in FIG. 2, described above.

The embodiment of the calender apparatus illustrated in FIG. 5C is equivalent to the alternative embodiment of the apparatus illustrated in FIG. 3, i.e., wherein the intermediate roll 102 of calender unit $A_{100}$ comprises a hard roll.

Referring now to FIG. 5D, the calender apparatus illustrated includes first and second calender units $A_{100}$ and $A_2$ which essentially corresponds to the calender units of the embodiment illustrated in FIG. 3 where the intermediate roll 102 of the first unit $A_{100}$ is journalled in the bracket 15 which is fixed to the frame 5. However, in the embodiment illustrated in FIG. 5D, the rolls 103 and 11 of units $A_{100}$ and $A_2$ are not mounted on a common set of pivoting arms as in FIG. 3 for reasons which will become clear hereinbelow.

The arrangement of the calender apparatus illustrated in FIG. 5D has the feature that the same also comprises a third calendering unit $A_{300}$ constituted by a roll stack including rolls 311, 312, and 313 whose axes are situated in the same vertical plane as are the axes of the rolls 101, 102 and 103 so that the rolls of both units $A_{100}$ and $A_{300}$ lie in the same vertical plane. All of the rolls of unit $A_{300}$ are hard rolls so that the calender unit $A_{300}$ including its loading and supporting apparatus is similar to a conventional machine calender, known per se.

Additionally, the embodiment of the calender apparatus illustrated in FIG. 5D has the feature that the lowermost end roll 103 of the first calender unit $A_{100}$ can be moved, such as by it being mounted on a pivotable lever arm, into nip defining contact either with the soft intermediate roll 102 of calender unit $A_{100}$ or with the hard roll 311 of the calender unit $A_{300}$. In this manner, the roll 103 may cooperate with one of two rolls to define either a soft nip or a hard nip.

When roll 103 is in nip defining contact with soft roll 102, as illustrated in FIG. 5D, the apparatus will operate in the manner described above in connection with FIGS. 1 and 5A.

On the other hand, when the roll 103 is moved into nip defining relationship with the hard roll 311 of calender unit $A_{300}$, an arrangement illustrated in FIG. 5E results. In this arrangement, the third calender unit $A_{300}$ with the hard roll 103 associated therewith will operate as a conventional machine calender wherein the web can follow a path such as that illustrated in FIG. 5E wherein all soft nips can be entirely bypassed. In the case where the embodiment illustrated in FIG. 5E is utilized with the web following the indicated path so as to bypass all soft nips and so as to operate as a machine calender with only hard nips, the rolls 101, 102, 11, 12 and 13 are of course not rotated. It is usual practice in this connection to maintain the unused soft nips in their open configuration in order to prevent damaging of the soft rolls by continued pressure in the nips.

The mode of operation of the embodiment illustrated in FIG. 5F is essentially the same as that described above in connection with FIG. 5C with the difference being that the path of the web W in the embodiment of FIG. 5F is such that both surfaces of the web are subjected to a supercalendering treatment. It is of course possible in this embodiment to bypass one of the two supercalendering units whereby a burnishing action is effected on a selected one of either the top or undersurfaces of the web. It is of course possible to conduct the web through both supercalendering units so that only a single side of the web will be burnished.

An alternative embodiment to the construction illustrated in FIG. 5F is accomplished by replacing the hard roll 102 by a soft roll. In this case, the calender apparatus will comprise three supercalendering units. Since only two supercalendering units are generally sufficient for achieving the desired gloss for the web surfaces, one of the three supercalendering units such, for example, as the unit comprising rolls 401, 402 and 403, may serve as a reserve unit. For example, if roll 12 were to be damaged during operation requiring replacement, the web can be arranged to travel through the nips defined by roll pairs 401, 402 and 402, 403 through appropriate provision of paper guide rolls (not shown). This is advantageous in that the calender apparatus need not be stopped for long durations and the continuous operation of the calender apparatus and the paper machine itself will be obtained even while the damaged apparatus is being repaired. As noted above, whichever calender unit comprises a reserve unit, the soft nips defined thereby will be maintained open so long as its rolls are not rotating.

The various embodiments described above have of course been presented as only examples of the present invention and it is understood that other embodiments of the design whose details deviate from those depicted in the figures are within the scope of the present invention.

The present invention is substantially based on the use of calender units, each including at least three rolls and wherein an intermediate roll may be a soft or hard roll disposed between two hard rolls and wherein the calender units are mounted on respective sides of an upstanding calender frame. Such a design overcomes the problem in prior art calendering apparatus of the deflection of the soft rolls which has resulted in poor operation in machine supercalenders of the prior art.

The present invention is advantageous in that through the use of separate calender units which are disposed on respective sides of the frame structure, it is possible to arrange the conduction of a web exhibiting two-sided surface characteristics through the calender in an appropriate manner so that the less uniform web surface will receive a more efficient treatment than the other surface. Similarly, the web burnishing may be effected in a manner such that the burnishing action is directed to the surface of the web which is inherently smoother.

The present invention provides the further advantage of a convenient placement of the web spreading roll between the calender units which is beneficial in that it is usually necessary to provide at least one of such spreading rolls in a supercalender in order to ensure the proper, trouble free operation of the supercalender.

The present invention is also suitable for the incorporation of many design features which are used in the prior art. For example, it has been found advantageous to utilize deflection-compensated or deflection-minimized rolls for the hard calender rolls so that a sufficiently uniform and, if necessary adjustable, line pressure is obtained in the various nips.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Calender apparatus adapted to be directly associated with a paper machine or the like or calendering a web and comprising a plurality of hard rolls with at least one soft roll defining nips, comprising: at least two separate calender units mounted on a unitary frame and spaced from one another, each of said calender units including at least one intermediate roll and two hard end rolls defining a respective pair of nips with said intermediate roll at substantially diametrically opposed sides thereof, and wherein the intermediate roll of at least one of said calender units comprises a soft roll defining a respective pair of soft nips with the two hard end rolls of said calender unit, whereby the web travels through and is treated by said calender units sequentially.

2. The combination of claim 1 further including means for opening and maintaining open the soft nips so as to enable the web to be carried through the calender apparatus during the starting-up phase thereof.

3. The combination of claim 1 further including means for threading the web in the calender apparatus including flexible carrier members running over said rolls.

4. The combination of claim 1 wherein in at least one of said calender units, said intermediate roll comprises a soft roll so that said respective pair of nips defined by said hard end rolls and intermediate soft roll are soft nips.

5. The combination of claim 1 wherein in each of all of said calender units said intermediate roll comprises a soft roll.

6. The combination of claim 5 wherein the calender unit in which the web is first treated further includes an additional hard roll in nip defining relationship with one of said end rolls so that the additional nip so defined is a hard nip and wherein said additional nip is first in the direction of travel of the web prior to any soft nips.

7. The combination of claim 1 wherein in the calender unit through which the web first travels, said intermediate roll comprises a hard roll so that said respective pair of nips defined by said hard end rolls and intermediate roll are hard nips and wherein the rolls of said calender unit next following said first calender unit in the direction of web travel define soft nips only, so as to comprise a supercalendering unit.

8. The combination of claim 1 wherein said apparatus includes first and second calender units mounted on said frame, the rolls of each of said first and second calender units having axes located in a common substantially vertical plane, said planes being transversely spaced from one another, said intermediate rolls of said two calender units comprising soft rolls, and further including a third calender unit the rolls of which have axes which are located in substantially the same vertical plane as the axes of the rolls of said first calender unit.

9. The combination of claim 8 wherein said third calender unit comprises only hard rolls and wherein means are provided for bringing the lowermost end roll of said first calender unit and the uppermost end roll of said third calender unit into nip defining relationship to define a calender unit having at least four rolls wherein soft nips can be bypassed.

10. The combination of claim 1 further including a web guiding and spreading roll located between said calender units for transferring the web from one calender unit to another.

11. The combination of claim 1 wherein said intermediate rolls of each of said calender units are fixedly journalled to said frame and wherein said end rolls of each of said calender units are mounted on arms which are pivotally secured to said frame; and further including means for applying a force to said arms for opening, closing and loading said nips.

12. The combination of claim 1 wherein the rolls of each of said calender units have axes located in a common substantially vertical plane, said planes being transversely spaced from each other, and wherein the hard lower end roll of each calender unit is journalled in a support which is fixed to said frame, and wherein the intermediate roll of each calender unit comprises a soft roll, and wherein said soft intermediate roll and hard upper end roll of each calender unit are journalled in bracket members which are mounted in cantilevered fashion to said frame, and further including means for applying a force to said brackets for opening and maintaining open the soft nips during the starting up phase of the operation of the calendering apparatus.

13. The combination of claim 1 wherein said apparatus includes first and second calender units mounted on opposed sides of said frame, the rolls of each of said first and second calender units having axes located in respective substantially vertical planes transversely spaced from one another, said intermediate roll of said first calender unit comprising a hard roll and said intermediate roll of said second calender unit comprising a soft roll, and further including a third calender unit the rolls of which have axes which are located in substantially the same vertical plane as the axes of the rolls of said second calender unit.

14. The combination of claim 13 wherein said intermediate roll of said third calendering unit comprises a soft roll.

* * * * *